US006480219B1

(12) United States Patent
Uejima et al.

(10) Patent No.: US 6,480,219 B1
(45) Date of Patent: Nov. 12, 2002

(54) EXPOSURE HEAD

(75) Inventors: Atsushi Uejima, Kanagawa (JP); Kenichi Kodama, Kanagawa (JP); Hisamitsu Hori, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/620,706

(22) Filed: Jul. 20, 2000

(30) Foreign Application Priority Data

Jul. 21, 1999 (JP) ..... 11-205964

(51) Int. Cl.[7] ..... B41J 27/00
(52) U.S. Cl. ..... 347/241; 347/256
(58) Field of Search ..... 347/241, 238, 347/256, 258, 244; 359/619, 622, 652, 663, 623; 349/95

(56) References Cited

U.S. PATENT DOCUMENTS 4,999,648 A 3/1991 Debesis ..... 347/241
5,121,254 A * 6/1992 Hamanaka et al. ..... 359/619
5,187,599 A * 2/1993 Nakanishi et al. ..... 349/95
5,568,320 A * 10/1996 Rees et al. ..... 359/652
5,648,874 A * 7/1997 Sawaki et al. ..... 359/622
5,712,674 A * 1/1998 Doi ..... 347/238
5,768,023 A * 6/1998 Sawaki et al. ..... 359/622
5,986,819 A * 11/1999 Steinblatt ..... 359/663

FOREIGN PATENT DOCUMENTS

JP 5-236216 A * 9/1993 ..... H04N/1/04
JP 2771932 4/1998 ..... G02B/26/10

* cited by examiner

*Primary Examiner*—Hai Pham
(74) *Attorney, Agent, or Firm*—Sughrue Mion, PLLC

(57) ABSTRACT

An exposure head is provided in which a deterioration in image quality, due to density non-uniformity or the like, of an image formed by using plural light beams can be suppressed. A microlens array is provided at a light-exiting side of a LED chip which has plural LED elements. The microlens array has microlenses of the same number as a number of LED elements. The microlenses are arranged in an array form at uniform intervals. The microlens array is lenses of an illumination system which, for example, limit spreading of light beams emitted from the LED chip. Light beams of homogeneous configurations and homogeneous profiles are illuminated onto a theoretical object plane at a time of focusing the light beams onto an exposure drum. In this way, the light beams emitted from the LED elements are illuminated with homogeneous configurations and at homogeneous light amount distributions onto illumination regions by the microlenses which function independently.

14 Claims, 12 Drawing Sheets

EXPOSURE HEAD

BACKGROUND OF THE INVENTION

1. Field of the Invention

The present invention relates to an exposure head, and in particular, to an exposure head which is used in an image exposure device or an image recording device or the like, and which can project, by a projection lens, a light beam from a suitable light source.

2. Description of the Related Art

Digital-exposure-type exposure devices are known in which a light beam, which has been modulated in accordance with image data, exposes a photosensitive material in order to record an image. In order to shorten the recording time, many plural-light-beam optical systems have been proposed in which a plurality of light beams substantially simultaneously expose a photosensitive material. In this case, when the optical system is structured by using plural light sources to obtain plural light beams, variations between light sources and assembly errors in the respective light sources lead to offset of pixels and non-uniformity of spot configurations due to positional errors of the respective light sources. Non-uniform density is caused in the obtained image, which results in a deterioration in image quality.

In order to overcome this drawback, techniques have been proposed for providing apertures at the light-exiting sides of the light sources in order to make the light spot configurations uniform, and for providing diffusion plates at the light-exiting sides of the light sources in order to make the light amounts uniform (see Japanese Patent No. 2771932 and U.S. Pat. No. 4,999,648). In these techniques, apertures of the same opening diameter are provided at the same pitch at the light-exiting sides of the plural light sources. These apertures are provided at the conjugate position with respect to the position of a photosensitive material. The light beams from the light sources which have been collimated onto the apertures are illuminated onto the photosensitive material, and the diffusion plates are provided in vicinities of the apertures. In this way, light beams, whose configurations and profiles have been made uniform, can be illuminated on the photosensitive material.

However, in these conventional techniques, although simply providing apertures or providing diffusion plates makes the spot configurations homogeneous to a certain extent, these techniques are not suitable for finely homogenizing the spot configurations because of the locality in the degree of diffusion of the diffusion plates.

Further, for example, it is difficult to fit a light source and an aperture, or an aperture and a diffusion plate closely together. Thus, positional errors arise in accordance with the distance between the light source and the aperture, or the distance between the aperture and the diffusion plate.

When diffusion plates are used, if the degree of diffusion thereof is low, at elements other than those on the optical axis of the focusing lens, the LED image and the two-dimensional light source image on the diffusion plate will be focused such that they are offset from one another, which leads to variation in the configuration.

SUMMARY OF THE INVENTION

In view of the aforementioned, an object of the present invention is to provide an exposure head in which a deterioration in image quality, such as non-uniform density or the like, in an image formed by using plural light beams can be suppressed.

In order to achieve the above object, an aspect of the present invention is an exposure head which projects a light beam from a light source onto a photosensitive material by a lens in an exposure device which exposes the photosensitive material, the exposure head comprising: the light source formed by a plurality of light emitting elements; and a lens array having lenses of a number corresponding to a number of the plurality of light emitting elements.

In the above-described exposure head, a lens array is provided which has lenses of a number corresponding to the number of light emitting elements, the lenses being provided at the light-exiting side of a light source in which a plurality of light emitting elements are arranged, for example, linearly. A microlens array in which a plurality of microlenses are arranged in an array form may be used as the lens array. In this way, even in a case in which the light beams from the light source are not uniform, light beams from the light source can be made uniform by the respective lenses of the lens array. Further, the diffusibility of the light at the light-exiting side of the lens array can be improved by the light collecting property of the lenses.

The lens array may be structured such that the configuration of the light-incident surface and the light-exiting surface of each of the lenses is convex. By increasing the distance between the light-incident surface and the light-exiting surface of each lens in such a lens array, each lens can function as a lens group in which two lenses are combined. An example of a lens in which the configuration of the light-incident surface and the configuration of the light-exiting surface are convex is a convex lens. By making each lens a lens in which the boundary surface configuration of the lens is convex (e.g., by making each lens a convex lens), for each of the lenses, the light beam can be collected along the optical axis.

Further, a plurality of lens arrays can be disposed in the optical axis direction. Namely, the light beams emitted from the light source can be collected by dividing the collecting functions up amongst the plurality of lenses. For example, a structure in which two lens arrays are disposed in the optical axis direction can be considered to be a structure corresponding to a so-called illumination-type optical system. In this case, the lenses (lens array) at the light source side corresponds to collector lenses, and the lenses (lens array) at the exposure side correspond to condenser lenses. By providing two lens arrays in this way, the optical settings relating to the light beams from the light source can be achieved easily.

Each lens of the lens array may be a lens having positive power, i.e., a convex lens.

The exposure head of the present invention may be provided with an aperture device in which a plurality of apertures are formed at uniform intervals, the number of the apertures corresponding to the number of the plurality of light emitting elements. The light beams passing through the respective lenses are limited by the apertures of the aperture device. Namely, the transmission of light beams at regions other than the periphery of the optical axis or on the optical axis of the lens can be suppressed.

The diameter of each aperture of the aperture device may be less than or equal to the effective diameter of the lens. In this way, only the light beams passing through the respective lenses are effectively limited.

The aperture device may be provided between the light-incident surfaces and the light-exiting surfaces of the respective lenses. In this way, only the light beams passing between the light-incident surface and the light-exiting surface of each lens are limited, and only the light beams passing through the apertures exit.

The exposure head of the present invention may further include a diffusing device for diffusing the light beams exiting from the lens array. The light beams exiting from the lens array can be efficiently diffused by the diffusing device.

The lens array may have a number of lenses which corresponds to a number which is greater, by an even number, than the number of the plurality of light emitting elements. For example, the same number of lenses may be provided at each side of the plurality of lenses corresponding to the plurality of light emitting elements. In this way, the same state can be obtained for each of the light emitting elements. Namely, for each of the light emitting elements, the light emitted from the light emitting element is incident on the corresponding lens as well as on the lenses adjacent to that lens. Namely, the light from the light emitting elements disposed end portions as well as the light from the light emitting elements disposed other than the end portions can be incident on the lenses adjacent to the corresponding lens as well as on the corresponding lens. The states of the obtained light beams can be made homogeneous.

DESCRIPTION OF THE PREFERRED EMBODIMENTS

Hereinafter, embodiments of the present invention will be described in detail with reference to the drawings. In the present embodiments, the present invention is applied to an image forming device which forms images by exposure on a photosensitive material by light beams from LEDs.

Figure 1:
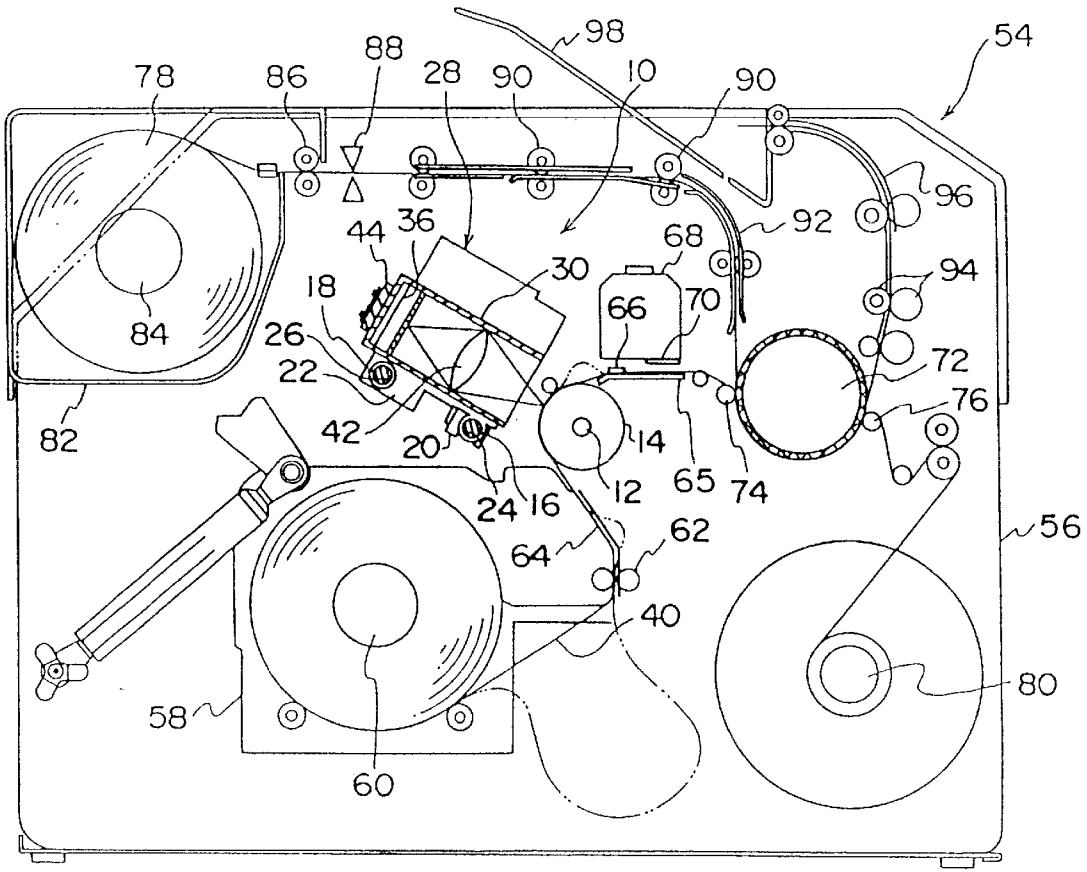
FIG. 1 is a schematic structural view of an image forming device equipped with an exposure section relating to embodiments of the present invention.
Figure 2:
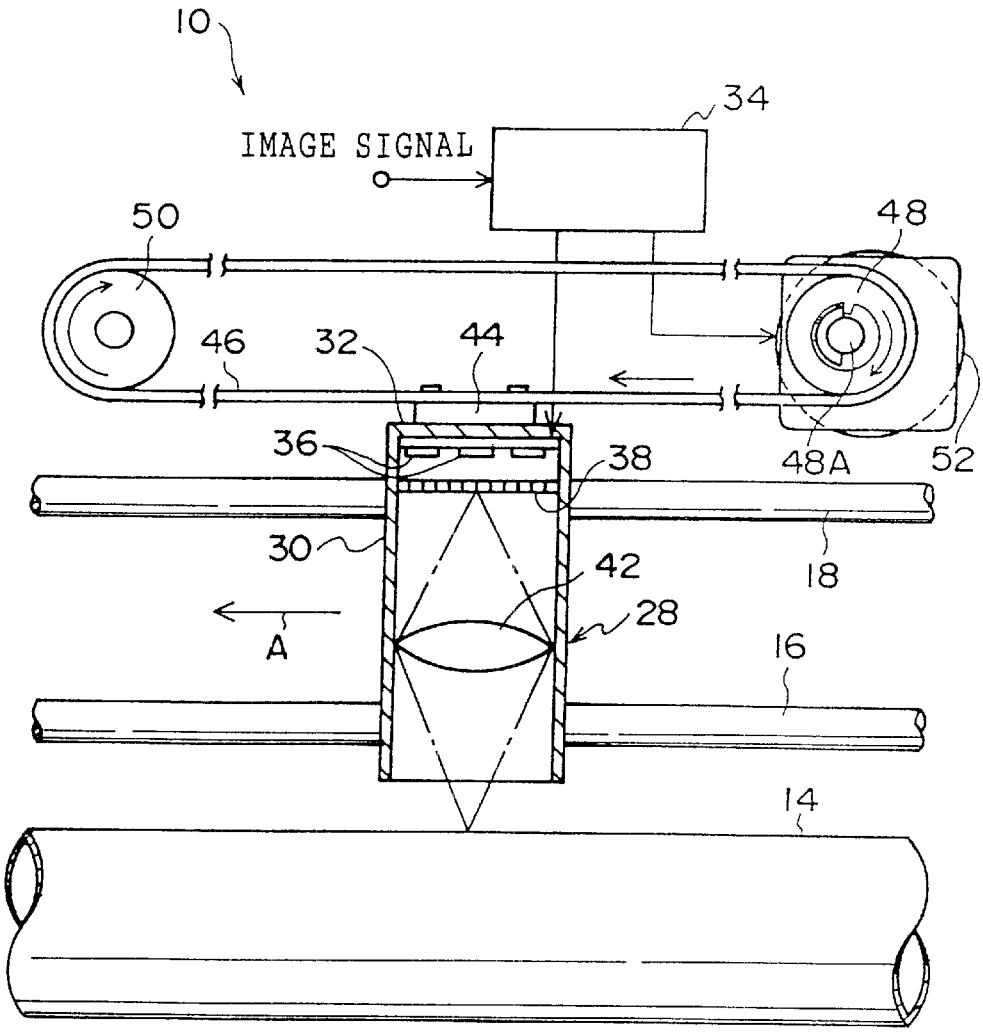
FIG. 2 is a schematic structural view of the exposure section which has a scanning head relating to the embodiments of the present invention.

An image forming device 54 equipped with an exposure section 10 relating to the embodiments of the present invention will be described. FIG. 1 illustrates the schematic structure of the image forming device 54 which includes the exposure section 10 relating to the embodiments of the present invention. FIG. 2 illustrates the schematic structure of the exposure section 10 relating to the embodiments of the present invention.

As illustrated in FIG. 1, a photosensitive material 40, which is wound around a supply reel 60, is set in a photosensitive material magazine 58 disposed at the lower portion of a housing 56 of the image forming device 54. The photosensitive material 40 is unwound by the supply reel 60 being rotated by an unillustrated drive means. The leading end portion of the photosensitive material 40 is nipped by pull-out rollers 62 provided at the removal opening of the photosensitive material magazine 58. The pull-out rollers 62 pull the photosensitive material 40 out under predetermined conditions, and feed the photosensitive material 40 to a guide plate 64, or form a buffer (illustrated by the two-dot chain line) under predetermined conditions.

The photosensitive material 40 which has passed by the guide plate 64 is trained around an exposure drum 14. The photosensitive material 40 is exposed by a scanning head 28 of the exposure section 10 which will be described in detail later, and an image is thereby formed on the photosensitive material 40. The photosensitive material 40 which has been exposed is nipped by a supporting stand 65 and a pressure plate 66, and water is applied thereto by a water-absorbent application member 70 (such as a sponge or the like) which is provided at an application tank 68. The photosensitive material 40 to which water has been applied is trained around a heat drum 72, in which a halogen lamp is housed, at a constant pressure by tension rollers 74, 76. While the photosensitive material 40 trained around the heat drum 72 is heated, the photosensitive material 40 is superposed on an image-receiving paper 78 (which will be described later) from the upper surface of the image receiving paper 78, such that the image is transferred onto the image receiving paper 78. The photosensitive material 40 whose image has been transferred is taken-up onto a disposal reel 80. In this way, the photosensitive material 40 extends from the supply reel 60 to the disposal reel 80 without being cut. Thus, the photosensitive material 40 itself functions as a timing belt which applies a constant pressure to the image receiving paper 78.

The image receiving paper 78 wound on a supply reel 84 is set in an image receiving material magazine 82 disposed in the upper portion of the housing 56. The image receiving paper 78 is pulled out by nip rollers 86, and after being cut to a predetermined length by a cutter 88, is guided by conveying rollers 90 and guide plate portion 92, and is trained about the heat drum 72 while being superposed with the photosensitive material 40. The image receiving paper 78, to which an image has been transferred from the photosensitive material 40, is peeled off from the heat drum 72 by a peeling claw (not shown), and is guided by conveying rollers 94 and a guide plate portion 96 so as to reach a tray 98.

Next, the exposure section 10 relating to the embodiments of the present invention, and peripheral portions of the exposure section 10 will be described. As illustrated in FIG. 1, at the exposure section 10, both end portions of the exposure drum 14, around which the photosensitive material is trained, are supported by a rotating shaft 12 which is rotatable. The exposure drum 14 is cylindrical, and the exposure surface thereof has a constant radius of curvature around the rotating shaft 12. Two shafts 16, 18 are disposed parallel to the rotating shaft 12 diagonally to the upper left of the exposure drum 14. The shafts 16, 18 pass through supporting holes 24, 26 formed in supporting blocks 20, 22, such that the supporting blocks 20, 22 are slidable along the shafts 16, 18. There are two supporting blocks 20 near the exposure drum 14, and one supporting block 22, and these three supporting blocks form a planar surface.

As illustrated in FIG. 2, a casing 30 of the scanning head 28 is fixed to the supporting blocks 20, 22. Three LED chips 36 of R, G, B, which are lit in accordance with signals from a controller 34 which stores image signals, are provided at the inner side of a bottom plate 32 of the casing 30. The light-emitting surfaces of the LED chips 36 are directed toward the inner side of the casing 30. The three LED chips 36 are aligned along the main scanning direction of the exposure head 28. Each of the LED chips 36 includes 31 elements along the subscanning direction.

As will be described in further detail later, a light source section 38 is provided at the light-emitting surface side of the LED chips 36. The light source section 38 may include a slit plate which limits the spreading of and/or diffuses the light beams emitted from the LED chips 36. A focusing lens 42 is disposed at the inner side of the light source section 38. The focusing lens 42 is formed by a plurality of lenses and an aperture, and serves to collect the light from the LED chips 36 and focus an image (the light) on the photosensitive material 40 trained about the exposure drum 14. Focusing is carried out automatically by an autofocus mechanism (not illustrated).

A connecting plate 44 is mounted to the outer surface of the bottom plate 32. An endless timing belt 46 is fixed to the connecting plate 44. The timing belt 46 is trained around sprockets 48, 50 provided in vicinities of the end portions of the shafts 16, 18. The shaft portion of the sprocket 48 is mounted to a driving shaft 48A of a reduction gear mechanism. The rotational force of a stepping motor 52 (rotational force of the forward rotation and reverse rotation of the driving shaft 48A) is transmitted to the sprocket 48, such that the scanning head 28 is moved reciprocally along the shafts 16, 18.

The driving of the stepping motor 52 is controlled by the controller 34, and is synchronous with the step driving of the photosensitive material 40. Namely, in a state in which the photosensitive material 40 is stopped during the step movement thereof, the stepping motor 52 is rotated forward such that the scanning head 28 moves in the transverse direction of the photosensitive material 40 (the main scanning direction) along the shafts 16, 18. After a predetermined number of pulses has been confirmed and when the photosensitive material 40 is again stopped during the step movement thereof, the stepping motor 52 is rotated reversely. In this way, the reciprocating main scanning is carried out.

Next, the light source section 38 will be described. In the present embodiment, the light source section 38 is provided which may include a slit plate for limiting the spreading of and/or diffusing the light beams emitted from the LED chips 36. The light source section 38 and the LED chips 36 are the light beam emitting portion of the scanning head 28 of the exposure section 10.

Figure 3:
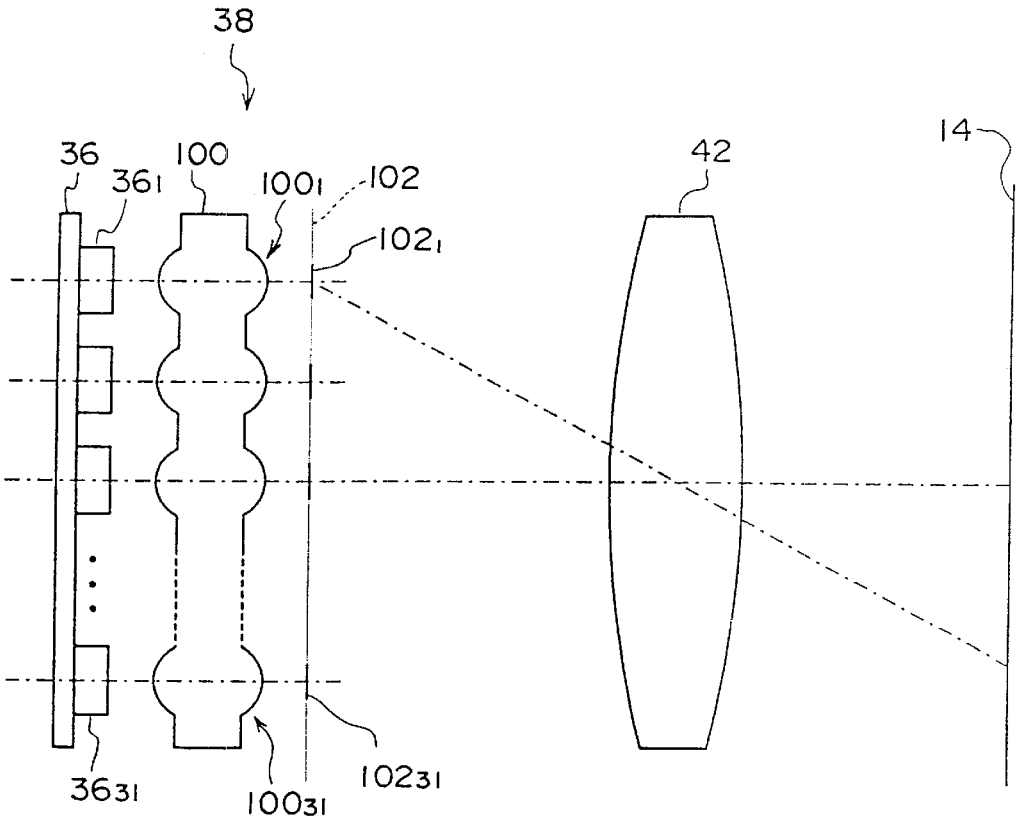
FIG. 3 is a schematic structural view illustrating a light source section within an exposure section relating to a first embodiment of the present invention.

As illustrated in FIG. 3, the LED chip 36 is provided with a plurality of LED elements $\mathbf{36}_1$ through $\mathbf{36}_{31}$. (In the present embodiment, there are 31 LED elements per LED chip 36). A microlens array 100 is provided at the light-exiting side of the LED chip 36. At the microlens array 100, microlenses $\mathbf{100}_1$ through $\mathbf{100}_{31}$, of the same number (31) as the number of LED elements provided at the LED chip 36, are disposed in an array form and so as to be separated from one another at constant intervals. Each of the microlenses $\mathbf{100}_1$ through $\mathbf{100}_{31}$ is structured to function as a convex lens in which the configuration of the light-incident surface and light-exiting surface thereof is convex.

The microlens array 100 is an illumination system lens which limits the spreading of and/or diffuses the light beams emitted from the LED chip 36. The microlens array 100 is for illuminating light beams of homogeneous configurations and homogeneous profiles onto a theoretical object plane 102 at the time of focusing the light beams onto the exposure drum 14. In the example illustrated in FIG. 3, the light beams emitted from the LED elements $\mathbf{36}_1$ through $\mathbf{36}_{31}$ are, by the microlenses $\mathbf{100}_1$ through $\mathbf{100}_{31}$ of the microlens array 100, made into light beams of homogeneous configurations and homogeneous profiles (light amount distributions), and illuminated onto illumination regions $\mathbf{102}_1$ through $\mathbf{102}_{31}$ of the object plane 102. Namely, because the configurations of the respective microlenses $\mathbf{100}_1$ through $\mathbf{100}_{31}$ can be made uniform and the microlenses $\mathbf{100}_1$ through $\mathbf{100}_{31}$ can be disposed at constant intervals, the obtained bundles of light are substantially the same.

In this way, an image can be formed on the exposure drum 14 by lights of homogeneous configurations and light amount distributions by the microlenses of the microlens array 100 which are disposed at fixed intervals. Accordingly, even in a case in which an LED chip is used in which the configurations of the respective LED elements are slightly non-uniform, the positional errors can be compensated for, and light beams of uniform light amount distributions can be obtained.

Here, if the distance between the light-incident surface and the light-exiting surface of one microlens array 100 (microlens) is made large, the microlens array 100 functions as a group lens in which two lenses are combined. The operation of the light source section 38 in such a case will now be described. For convenience of explanation, illumination of a light beam emitted from one optical system, i.e., from the LED element $\mathbf{36}_1$, onto the illumination region $\mathbf{102}_1$ of the object plane 102 by the microlens $\mathbf{100}_1$ will be described.

Figure 4:
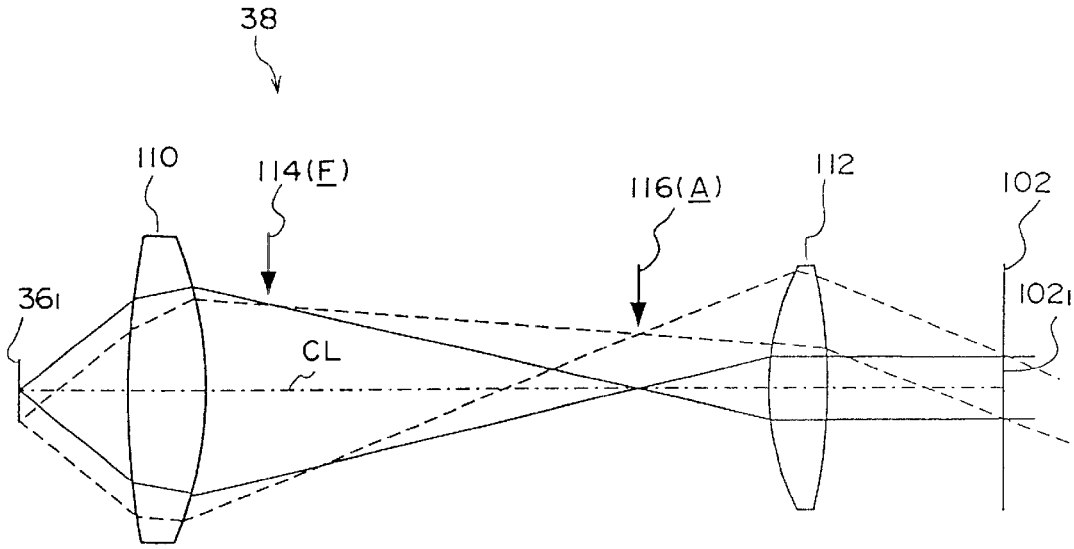
FIG. 4 is a view for explanation which illustrates a schematic structure of the light source section in which the thickness of a microlens has been increased.

As illustrated in FIG. 4, the microlens $\mathbf{100}_1$ (microlens array 100) is structured so as to function as a first lens 110 and a second lens 112. Specifically, the front-side focal point position of the second lens 112 is set at the position at which the light source image is focused by the first lens 110 (a plane orthogonal to an optical axis CL and including arrow 116 in FIG. 4, hereinafter called aperture plane A). In this case, the conjugate position (a plane orthogonal to the optical axis CL and including the arrow 114 in FIG. 4, hereinafter called field of view plane F) of the second lens 112 of the object plane 102 is the position of the light-exiting side of the first lens, and is not affected by the configuration and position of the LED element.

This means that the LED element $\mathbf{36}_1$ and the aperture plane A are conjugate via the first lens 110, that the field of view plane F and the object plane 102 are conjugate via the second lens 112, and that the aperture plane A is positioned at the front-side focal point position of the second lens 112. It is preferable that the field of view plane F is positioned at the rear-side focal point position of the first lens 110.

Due to the above structure, the light beam emitted from the LED element $\mathbf{36}_1$ passes through the first lens 110, and thereafter, spreads onto the field of view plane F, is focused on the aperture plane A, passes through the second lens 112, and at the object plane 102, is made into a predetermined beam. In this way, even if there is non-uniform luminance at the LED element $\mathbf{36}_1$, at the object plane 102, the beam can be illuminated homogeneously.

The bundles of rays which are illuminated homogeneously at the respective illumination regions of the object plane 102 are focused onto the photosensitive material 40 by the focusing lens 42. In this way, the positional errors of the LED elements are eliminated, and a focused spot formed by a light beam of a uniform light amount distribution can be obtained. Therefore, there is no unevenness of density in the obtained image, and a deterioration in image quality can be suppressed.

Next, a second embodiment of the present invention will be described. Because the present second embodiment has a similar structure as that of the above-described first embodiment, the same portions will be denoted by the same reference numerals, and description of these same portions will be omitted. The portions of the light source section 38 which differ from the first embodiment will be described.

Figure 5:
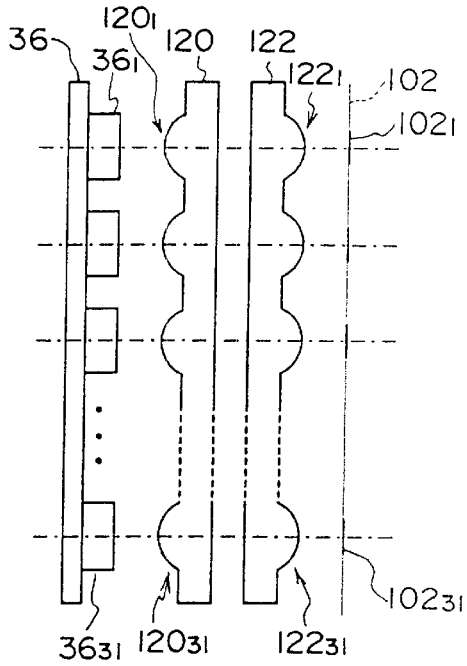
FIG. 5 is a schematic structural view illustrating a light source section within an exposure section relating to a second embodiment of the present invention.

In the above-described first embodiment, the one microlens array is structured to function as a group lens in which two lenses are combined. However, in order to simplify the structure, it is preferable that a plurality of independent microlens arrays are combined. Thus, in the present second embodiment, as illustrated in FIG. 5, the microlens array 100 is structured by a first microlens array 120 and a second microlens array 122. In the example illustrated in FIG. 5, the light beams emitted from the LED elements $\mathbf{36}_1$ through $\mathbf{36}_{31}$ are, by pairs of microlenses $\mathbf{120}_1$, $\mathbf{122}_1$ through $\mathbf{120}_{31}$, $\mathbf{122}_{31}$ of the microlens arrays 120 and 122, made into light beams of homogeneous configurations and homogeneous profiles (light amount distributions), and are illuminated onto the illumination regions $\mathbf{102}_1$ through $\mathbf{102}_{31}$ of the object plane 102.

Due to this structure, the first microlens array 120 and the second microlens array 122 can be designed and manufactured independently of one another. Thus, the number of degrees of freedom in design increases.

Next, a third embodiment of the present invention will be described. Because the present third embodiment has a similar structure to those of the above-described embodiments, the same portions will be denoted by the same reference numerals, and description of these same portions will be omitted. The portions of the light source section 38 which differ from the previous embodiments will be described.

Figure 6:
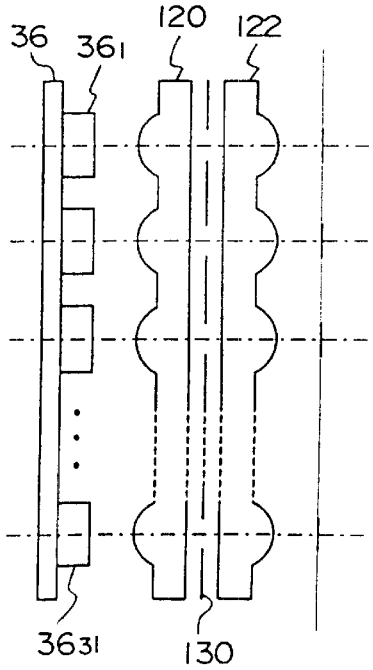
FIG. 6 is a schematic structural view illustrating a light source section within an exposure section relating to a third embodiment of the present invention.

In the above embodiments, the spreading of the light beams emitted from the LED chip 36 is limited and/or the light beams emitted from the LED chip 36 are diffused by a microlens array. However, it is preferable that light beams other than those which are on the optical axis and in a vicinity of the optical axis are blocked. Here, in the present third embodiment, as illustrated in FIG. 6, an aperture array 130 is provided between the microlens arrays 120, 122 which are formed so as to be separate from and independent of one another.

The aperture array 130 has a number of apertures which is the same as the number of LED elements $\mathbf{36}_1$ through $\mathbf{36}_{31}$ and the number of pairs of microlenses $\mathbf{120}_1$, $\mathbf{122}_1$ through $\mathbf{120}_{31}$, $\mathbf{122}_{31}$ of the microlens arrays 120 and 122. The apertures are formed in the aperture array 130 at the same, constant interval as the intervals between the microlenses. Each aperture of the aperture array 130 is smaller than the effective diameter of each of the microlenses of the microlens array.

It is preferable that the optical axis direction position of the aperture array 130 is set in a vicinity of the aperture plane A or in a vicinity of the field of view plane F which were described previously with reference to FIG. 4. An aperture in the field of view plane F corresponds to the so-called field stop. When the aperture is provided in a vicinity of the field of view plane F, the region of the light beam illuminated onto the object plane 102 can be limited by the size of the aperture. Further, an aperture in the aperture plane A corresponds to a so-called aperture stop. When the aperture is provided in a vicinity of the aperture plane A, the light beams passing through the optical axis and in the periphery of the optical axis can be limited by the size of the aperture, i.e., the total amount of the light beams illuminated onto the object plane 102 can be limited by the size of the aperture. Incidentally, it is possible to provide plural aperture arrays 130.

In this way, in the present third embodiment, because the aperture array which serves as a so-called aperture is provided, it is easy to make the light amount distributions and the configurations of the light spots obtained on the object plane uniform. Thus, the bundles of rays illuminated homogeneously onto the respective illumination regions of the object plane 102 are focused onto the photosensitive material 40 by the focusing lens 42, and focused spots formed by the light beams which are uniform and have homogeneous light amount distributions can thereby be obtained on the photosensitive material 40 at uniform intervals. Thus, there is no non-uniformity of density in the obtained image, and a deterioration in image quality can be suppressed.

In the present third embodiment, the aperture array 130 is provided between the two microlens arrays. However, the present invention is not limited to the same, and the aperture array 130 may be provided within one microlens array 100.

Further, the aperture array 130 may be sandwiched between microlens arrays 120 and 122 so as to join these arrays and form a single microlens array. Moreover, in order to limit the light amounts of the light beams emitted from the microlens array, the aperture array 130 may be provided at the light-exiting side of the microlens array.

As another means for blocking the light beams other than those on the optical axis and in the vicinity of the optical axis, light-shading members, e.g., light shading plates, may be provided between adjacent microlenses of the microlens array.

Next, a fourth embodiment of the present invention will be described. Because the present fourth embodiment has a similar structure as those of the above-described embodiments, the same portions will be denoted by the same reference numerals, and description of these same portions will be omitted. The portions of the light source section 38 which differ from the previous embodiments will be described.

Figure 7:
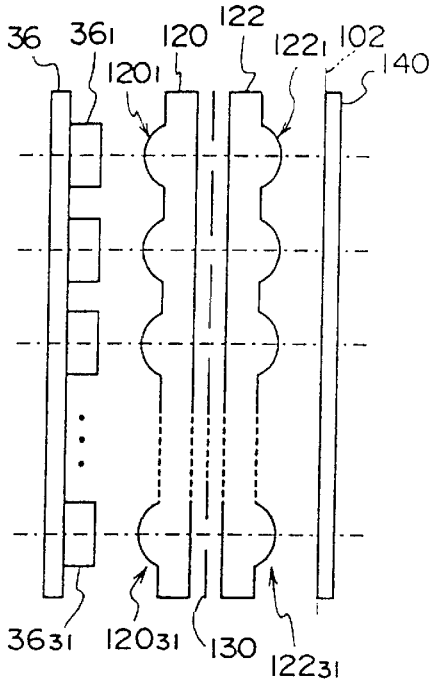
FIG. 7 is a schematic structural view illustrating a light source section within an exposure section relating to a fourth embodiment of the present invention.

In the above-described embodiments, a case was described in which spreading of the light beams emitted from the LED chip 36 is limited by the microlens array and/or the light beams emitted from the LED chip 36 are diffused by the microlens array, and an aperture of the microlens array is applied. However, there are cases in which the diffusibility at the object plane side 102 is low. Thus, in the present fourth embodiment, as illustrated in FIG. 7, a diffusing plate 140 is provided at a position in a vicinity of the object plane 102.

Due to this structure, light spots having improved diffusibility can be obtained on the object plane 102 which is the position conjugate with the photosensitive surface of the photosensitive material 40. Thus, bundles of light made homogeneous at the illumination regions of the object plane 102 are focused on the photosensitive material 40 by the focusing lens 42, and therefore, focused spots formed by light beams which are uniform and have homogeneous light amount distributions can be obtained at uniform intervals on the photosensitive material 40. Thus, there is no non-uniformity of density in the obtained image, and a deterioration in image quality can be suppressed.

Next, a fifth embodiment of the present invention will be described. Because the present fifth embodiment has a similar structure as those of the above-described embodiments, the same portions will be denoted by the same reference numerals, and description of these same portions will be omitted. The portions of the light source section 38 which differ from the previous embodiments will be described.

In the above-described embodiments, a structure is described in which spreading of light beams emitted from the LED chip 36 is limited and/or the light beams emitted from the LED chip 36 are diffused by the microlens array having a number of microlenses which is the same as the number of LED elements of the LED chip 36. However, there are cases in which the microlenses are affected by light beams from the adjacent LED elements. Namely, there are cases in which the state of a light spot on the object plane 102 illuminated by a light beam from an LED element (LED elements $\mathbf{36}_1$ and $\mathbf{36}_{31}$) in the vicinity of a subscanning direction end portion is a different state than the state of a beam spot on the object plane 102 illuminated by another light beam. This is because at a single microlens, there is the possibility that light beams from the same number of LED elements at the left and the right may be incident on that microlens, whereas at an end portion microlens, e.g., at the microlens $\mathbf{120}_1$ or $\mathbf{120}_{31}$, there is the possibility that a light beam from an LED element only at either the left or the right thereof may be incident onto that microlens.

Figure 8:
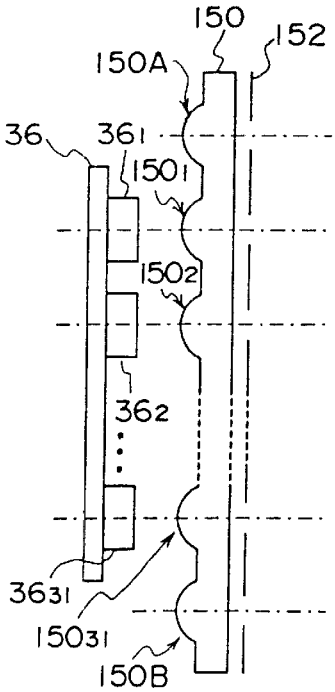
FIG. 8 is a schematic structural view illustrating a light source section within an exposure section relating to a fifth embodiment of the present invention.

Thus, in the present embodiment, as illustrated in FIG. 8, a microlens array 150 and an aperture array 152 are provided at the light-exiting side of the LED chip 36. The microlens array 150 has a number of microlenses which is greater, by an even number, than the number of LED elements at the LED chip 36. Namely, at the microlens array 150, in addition to the microlenses $\mathbf{150}_1$ through $\mathbf{150}_{31}$ of the same number as the number (31) of LED elements at the LED chip 36, there is an additional even number (two in the present embodiment) of microlenses (microlenses 150A, 150B) provided at the end portions of the microlens array 150. All of the microlenses in the microlens array 150 are disposed in an array form at uniform intervals. Accordingly, the microlenses 150A, 150B, onto which no direct light beam is incident (no light beam whose direction is parallel to the optical axis is incident) from the LED elements of the LED chip 36, are additionally provided at the end portions of the microlens array 150.

The aperture array 152 is provided at the light beam exiting side of the microlens array 150. In the same way as the microlens array 150, the aperture array 152 has a number of apertures which is greater, by an even number, than the number of LED elements at the LED chip 36.

Here, let us consider the light beams of the LED elements $\mathbf{36}_1$, $\mathbf{36}_2$ of the LED chip 36. First, the light beam of the LED element $\mathbf{36}_2$ is illuminated onto the corresponding microlens $\mathbf{150}_2$. However, because this light beam diverges, it is illuminated onto the adjacent microlenses $\mathbf{150}_1$, $\mathbf{150}_3$ ($\mathbf{150}_3$ is not shown) as well. It can thus be assumed that light beams from the microlenses $\mathbf{150}_1$, $\mathbf{150}_2$, $\mathbf{150}_3$ ($\mathbf{150}_3$ is not shown) are illuminated by the LED element $\mathbf{36}_2$ onto the illumination region $\mathbf{102}_2$ for the LED element $\mathbf{36}_2$. Namely, the illumination region $\mathbf{102}_2$ is affected not only by light from the microlens $\mathbf{150}_2$, but also by light from the microlenses adjacent to the microlens $\mathbf{150}_2$.

In the present embodiment, the microlens 150A and an aperture of the aperture array 152 are provided at the outer side of the microlens $\mathbf{150}_1$. Namely, additional structures of a microlens and an aperture for an LED element are provided. Accordingly, it can be assumed that the light beams from the microlenses $\mathbf{150}_1$, $\mathbf{150}_2$, 150A are illuminated by the LED element $\mathbf{36}_1$ onto the illumination region $\mathbf{102}_1$ for the LED element $\mathbf{36}_1$.

In this way, in consideration of the fact that the light from an LED element is incident not only on the corresponding microlens but also on the microlenses adjacent to that microlens, the number of microlenses and apertures is increased. Thus, light beams of homogeneous configurations and homogeneous profiles (light amount distributions) are illuminated onto the object plane. Namely, the respective light beams from the LED elements $\mathbf{36}_1$ through $\mathbf{36}_{31}$ are illuminated homogeneously onto the object plane.

By increasing the number of microlenses of the microlens array and the number of apertures of the aperture array by an even number in this way, the respective light beams from the LED elements $\mathbf{36}_1$ through $\mathbf{36}_{31}$ are illuminated homogeneously onto the object plane. Thus, bundles of light beams made homogeneous at the illumination regions of the object plane 102 are focused onto the photosensitive material 40 by the focusing lens 42. In this way, focused spots formed by light beams which are uniform and have homogeneous light amount distributions can be obtained on the photosensitive material 40 at uniform intervals. Non-uniformity of density is not caused in the obtained image, and a deterioration in image quality can be suppressed.

In the above-described embodiments, cases are described in which the exposure head writes an image. However, the present invention is also applicable to a scanner for reading an image.

Next, a sixth embodiment of the present invention will be described. Because the present sixth embodiment has a similar structure as those of the above-described embodiments, the same portions will be denoted by the same reference numerals, and description of these same portions will be omitted. The portions of the light source section 38 which differ from the previous embodiments will be described.

In the first embodiment, a case is described in which one microlens array 100 is provided at the light-exiting side of the LED chip 36. However, in the present sixth embodiment, as illustrated in FIG. 9, two microlens arrays 100A, 100B are disposed at the light-existing side of the LED chip 36.

The microlens arrays 100A, 100B have the same structure. Microlenses 100A, through 100$A_{31}$ and 100$B_1$ through 100$B_{31}$ of the same number as the number of LED elements (31 elements) provided at the LED chip 36 are arranged in array forms at uniform intervals at the microlens arrays 100A and 100B.

Figure 9:
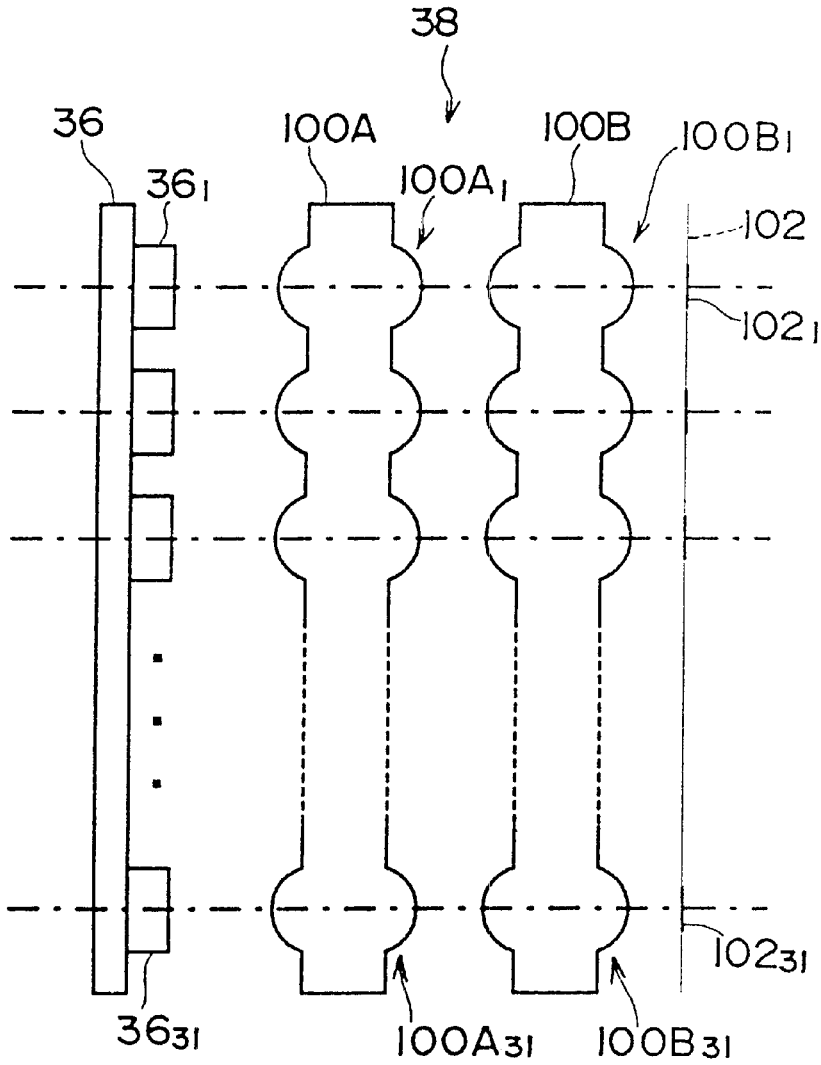
FIG. 9 is a schematic structural view illustrating a light source section within an exposure section relating to a sixth embodiment of the present invention.

In the example of FIG. 9, the light beams emitted from the LED elements 36$_1$ through 36$_{31}$ are, by the microlenses 100$A_1$ through 100$A_{31}$ and 100$B_1$ through 100$B_{31}$ of the microlens arrays 100A and 100B, made into light beams of homogeneous configurations and homogeneous profiles (light amount distributions), and illuminated onto the illumination regions 102$_1$ through 102$_{31}$ of the object plane 102.

In this way, the microlens arrays 100A, 100B can be designed and manufactured independently of one another, and the degrees of freedom in design can be increased.

Next, a seventh embodiment of the present invention will be described. Because the present seventh embodiment has a similar structure as those of the above-described embodiments, the same portions will be denoted by the same reference numerals, and description of these same portions will be omitted. The portions of the light source section 38 which differ from the previous embodiments will be described.

Figure 10:
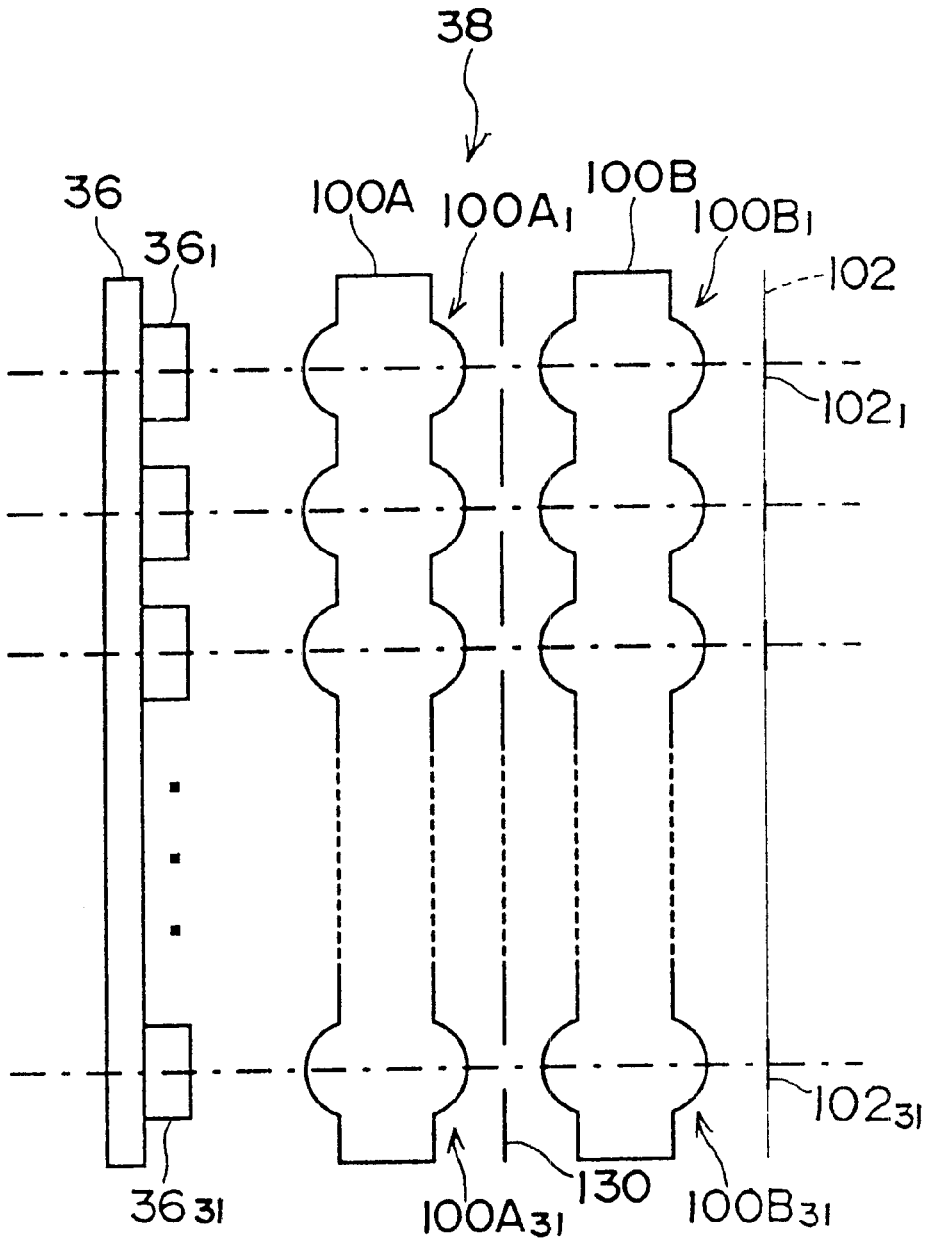
FIG. 10 is a schematic structural view illustrating a light source section within an exposure section relating to a seventh embodiment of the present invention.

In the first embodiment, a case is described in which one microlens array 100 is provided at the light-exiting side of the LED chip 36. However, in the present seventh embodiment, as illustrated in FIG. 10, the two microlens arrays 100A, 100B are disposed at the light-exiting side of the LED chip 36, and the aperture array 130 is provided between the microlens arrays 100A, 100B.

The aperture array 130 has a number of apertures which is the same as the number of LED elements 36$_1$ through 36$_{31}$ and the number of microlenses 100$A_1$ through 100$A_{31}$ and 100$B_1$ through 100$B_{31}$ of the microlens arrays 100A and 100B. The apertures are formed in the aperture array 130 at the same, constant intervals as the intervals between the microlenses. Each aperture of the aperture array 130 is smaller than the effective diameter of the microlens of the microlens array.

It is preferable that the optical axis direction position of the aperture array 130 is set in a vicinity of the aperture plane A or in a vicinity of the field of view plane F which were described previously with reference to FIG. 4. An aperture in the field of view plane F corresponds to the so-called field stop. When the aperture is provided in a vicinity of the field of view plane F, the region of the light beam illuminated onto the object plane 102 can be limited by the size of the aperture. Further, an aperture in the aperture plane A corresponds to a so-called aperture stop. When the aperture is provided in a vicinity of the aperture plane A, the light beams passing through in the periphery of the optical axis or on the optical axis can be limited by the size of the aperture, i.e., the total amount of the light beams illuminated onto the object plane 102 can be limited by the size of the aperture. Incidentally, it is possible to provide plural aperture arrays 130.

In this way, in the present seventh embodiment, because the aperture array which serves as a so-called aperture is provided, it is easy to make the light amount distributions and the configurations of the light spots obtained on the object plane uniform. Thus, the bundles of rays illuminated homogeneously onto the respective illumination regions of the object plane 102 are focused onto the photosensitive material 40 by the focusing lens 42, and focused spots formed by the light beams which are uniform and have homogeneous light amount distributions can thereby be obtained on the photosensitive material 40 at uniform intervals. Thus, there is no non-uniformity of density in the obtained image, and a deterioration in image quality can be suppressed.

In the present seventh embodiment, the aperture array 130 is provided between the two microlens arrays. However, the present invention is not limited to the same, and the aperture array 130 may be provided at the interior of each of the two microlens arrays 100A, 100B. Moreover, in order to limit the light amounts of the light beams emitted from the microlens array, the aperture array 130 may be provided at the light-exiting side of the microlens array.

As another means for blocking the light beams other than those on the optical axis and in a vicinity of the optical axis, light-shading members, e.g., light shading plates, may be provided between adjacent microlenses of the microlens array.

Next, an eighth embodiment of the present invention will be described. Because the present eighth embodiment has a similar structure as those of the above-described embodiments, the same portions will be denoted by the same reference numerals, and description of these same portions will be omitted. The portions of the light source section 38 which differ from the previous embodiments will be described.

Figure 11A:
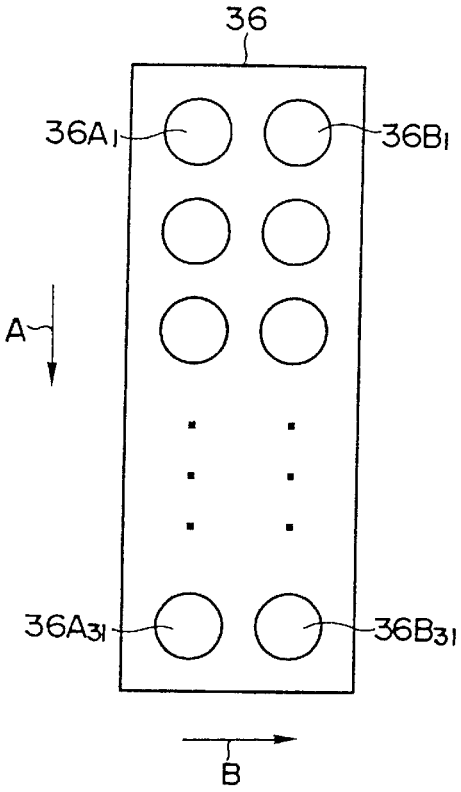
FIG. 11A is a plan view of an LED chip of a light source section within an exposure section relating to an eighth embodiment of the present invention.

In the above-described embodiments, a case is described in which the LED chip 36 is structured such that the 31 elements are disposed in one row in the subscanning direction. However, in the present eighth embodiment, as illustrated in FIG. 11A, the LED chip 36 is structured so as to have two rows of 31 LED elements 36$A_1$ through 36$A_{31}$ and 36$B_1$ through 36$B_{31}$ aligned along the subscanning direction (the direction of arrow A).

Figure 11B:
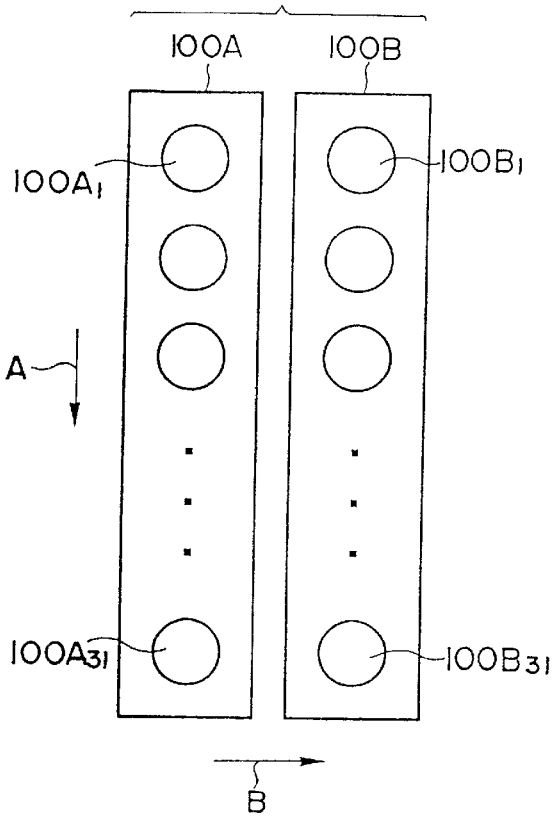
FIG. 11B is a plan view of a microlens array of the light source section within the exposure section relating to the eighth embodiment of the present invention.
Figure 11C:
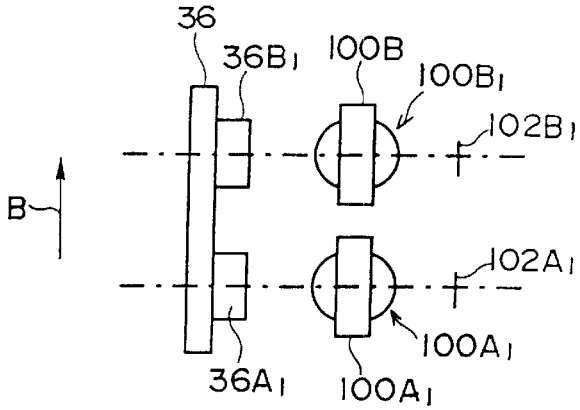
FIG. 11C is a view, as seen from above, of FIGS. 11A and 11B.

Further, as shown in FIGS. 11B and 11C, the microlens arrays 100A, 100B are disposed in the main scanning direction (the direction of arrow B) at the light emitting side of the LED chip 36.

Figure 12A:
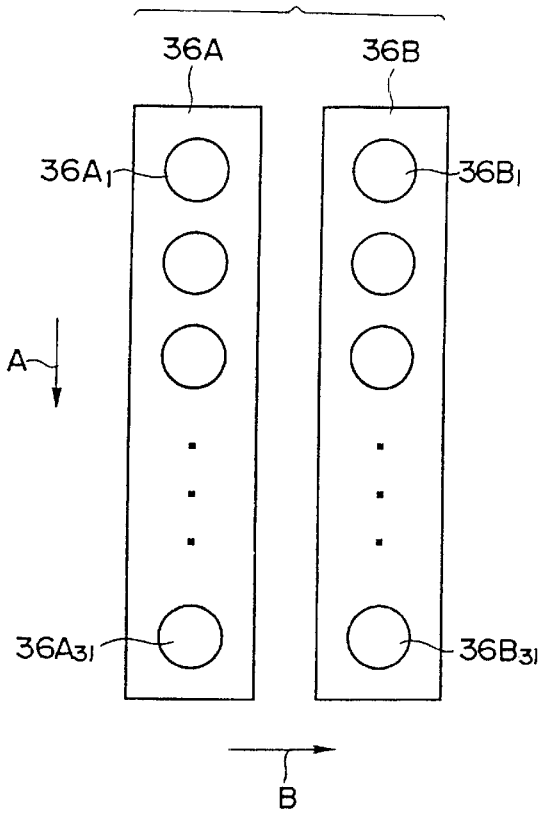
FIG. 12A is a plan view of an LED chip of the light source section within the exposure section relating to the eighth embodiment of the present invention.
Figure 12B:
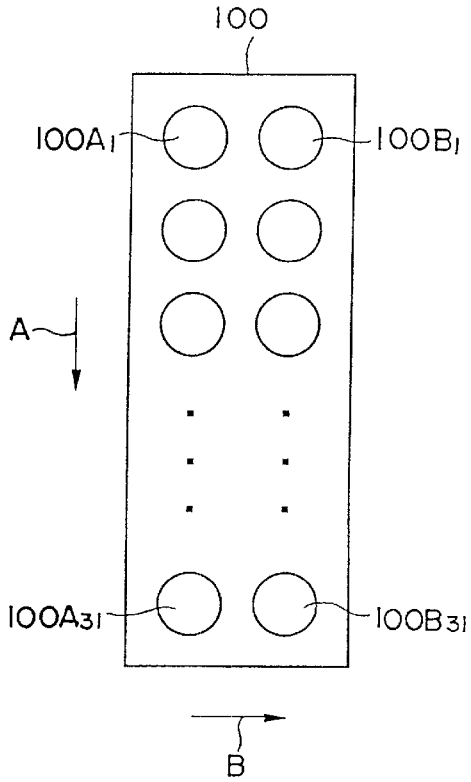
FIG. 12B is a plan view of a microlens array of the light source section within the exposure section relating to the eighth embodiment of the present invention.
Figure 12C:
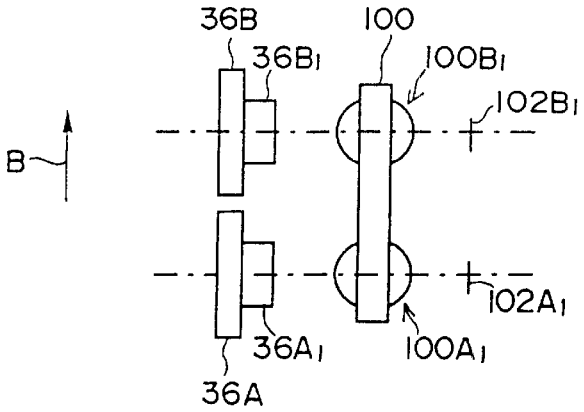
FIG. 12C is a view, as seen from above, of FIGS. 12A and 12B.

As shown in FIGS. 12A and 12C, the LED chip 36 may be structured by two LED chips 36A, 36B disposed along the main scanning direction (the direction of arrow B). As illustrated in FIG. 12B, the microlens array 100 may be formed by two rows of 31 microlenses, the microlenses 100$A_1$ through 100$A_{31}$ and 100$B_1$ through 100$B_{31}$, which are aligned in the subscanning direction (the direction of arrow A).

Figure 13A:
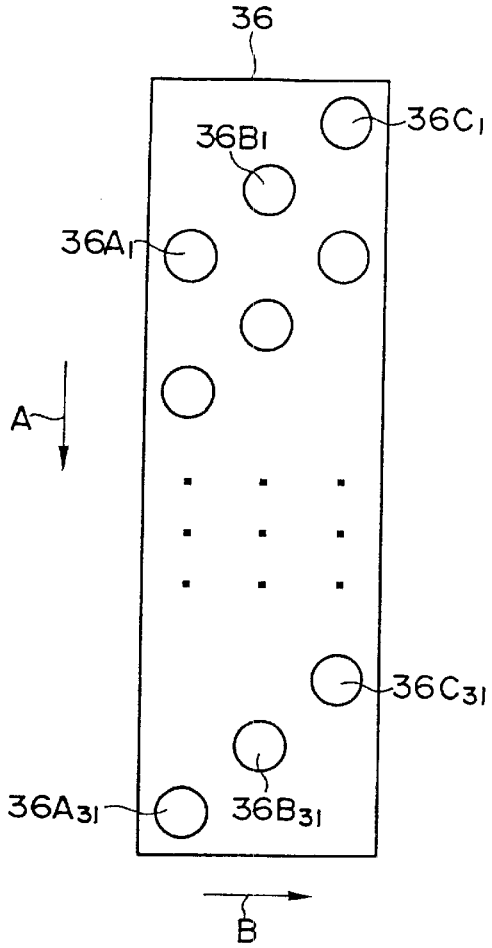
FIG. 13A is a plan view of an LED chip of the light source section within the exposure section relating to the eighth embodiment of the present invention.
Figure 13B:
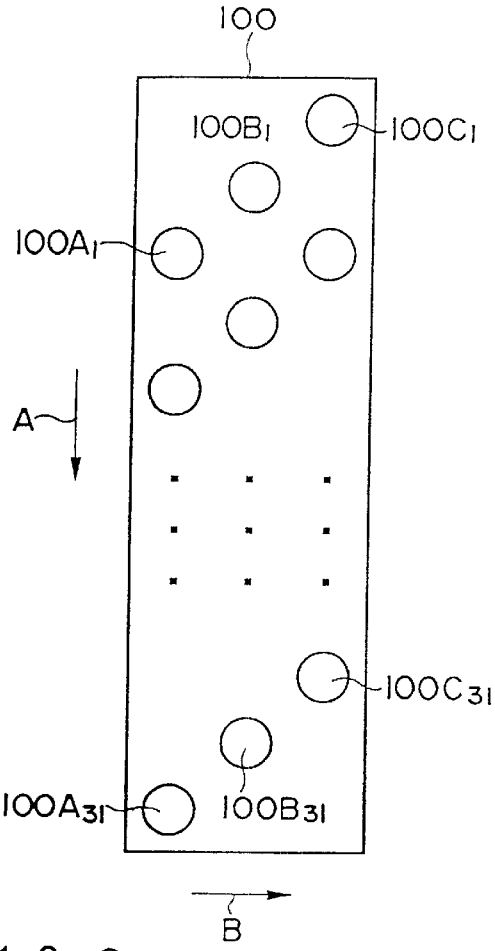
FIG. 13B is a plan view of a microlens array of the light source section within the exposure section relating to the eighth embodiment of the present invention.
Figure 13C:
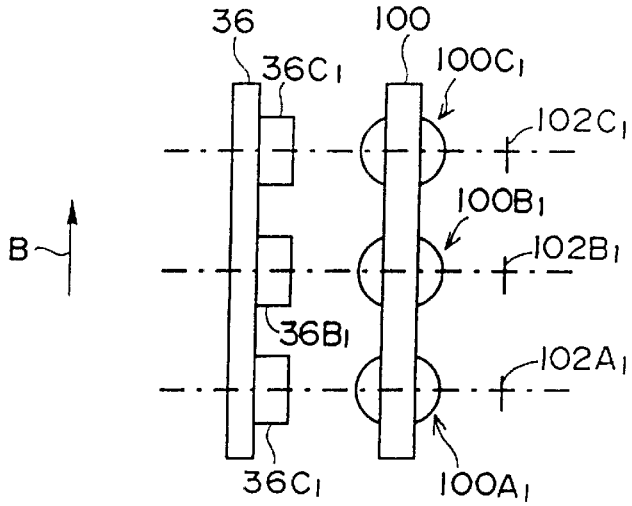
FIG. 13C is a view, as seen from above, of FIGS. 13A and 13B.

Moreover, as shown in FIGS. 13A and 13C, the LED chip 36 may be structured so as to have three rows of 31 LED elements 36$A_1$ through 36$A_{31}$, and 36$B_1$ through 36$B_{31}$, and 36$C_1$ through 36$C_{31}$ aligned along the subscanning direction (the direction of arrow A). In this case, as shown in FIG. 13B, in the same way as the LED elements, the microlens array 100 may be formed so as to include three rows of 31 microlenses, microlenses 100$A_1$ through 100$A_{31}$ and 100$B_1$ through 100$B_{31}$ and 100$C_1$ through 100$C_{31}$, which are aligned in the subscanning direction (the direction of arrow A). In the examples illustrated in FIGS. 13A and 13B, the LED elements of the three rows and the microlenses of the three rows are disposed so as to be staggered by a predetermined distance in the subscanning direction. However, the arrangement of the LED elements and the microlenses is not limited to this arrangement.

Figure 14A:
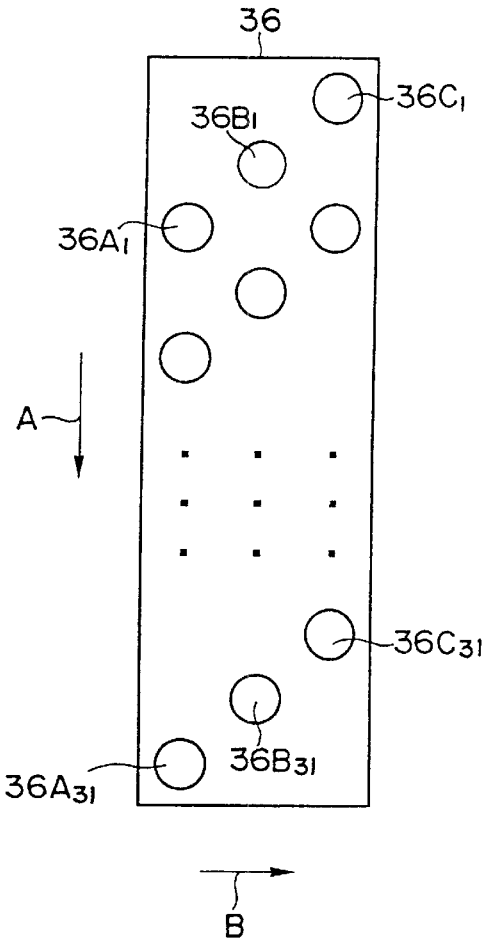
FIG. 14A is a plan view of an LED chip of the light source section within the exposure section relating to the eighth embodiment of the present invention.
Figure 14B:
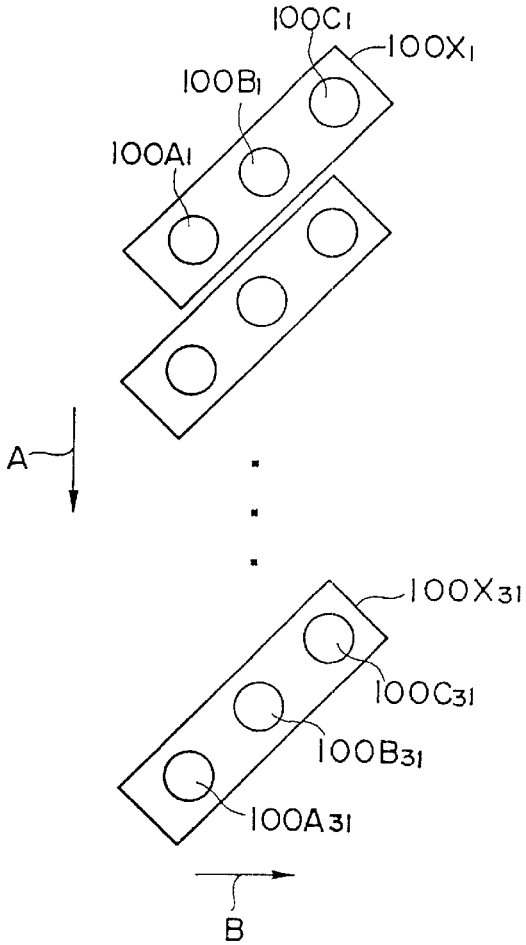
FIG. 14B is a plan view of a microlens array of the light source section within the exposure section relating to the eighth embodiment of the present invention.
Figure 14C:
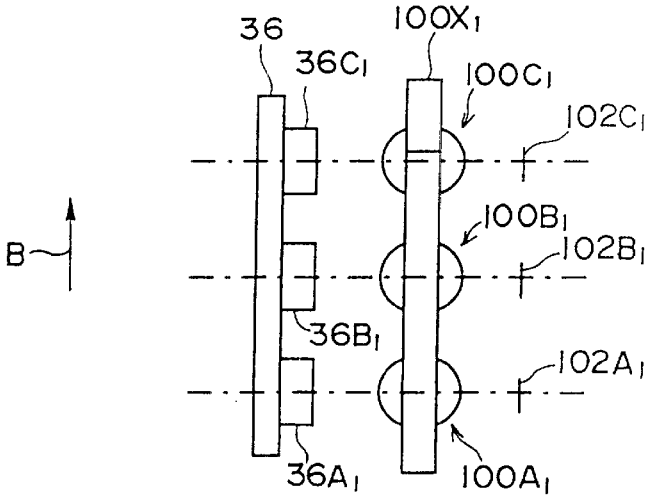
FIG. 14C is a view, as seen from above, of FIGS. 14A and 14B.

Further, as illustrated in FIG. 14B, the microlens array 100 may be structured by 31 individually separate microlens arrays 100$X_1$ through 100$X_{31}$.

As described above, in accordance with the present invention, when light beams from plural light emitting elements are projected, a lens array, which has a number of lenses corresponding to the number of light emitting elements, is provided at the light-exiting side of the light source in which the plural light emitting elements are aligned. Therefore, even if there are variations among the light sources, the light beams from the light sources can be made uniform by the lenses of the lens array. Further, the diffusibility of the light at the light-exiting side of the lens array can be improved by the light collecting property of the lenses.

Further, by using, as the lens array, plural lens arrays in which a plurality of lens arrays are disposed along the optical axis direction, the function of collecting the light beams emitted from the light sources can be divided up amongst the plurality of lenses. Optical design relating to the light beams from the light sources is facilitated.

An aperture device, in which apertures are formed at uniform intervals, the number of apertures corresponding to the number of light emitting elements, may be provided. In this way, the light beams passing through the lenses can be limited, such that the transmission of light beams other than the light beams at the optical axis of the lens and in a vicinity of the optical axis of the lens can be suppressed.

By also providing a diffusing device for diffusing the light beams exiting from the lens array, the light beams exiting from the lens array can be diffused efficiently.

Further, a lens array may be used which has a number of lenses which is greater, by an even number, than the number of light emitting elements. In this way, all of the lenses can be made to be in the same light state, and the states of the obtained light beams can be made homogeneous for each of the light sources.

What is claimed is:

1. An exposure head which projects a light beam from a light source onto a photosensitive material by a lens in an exposure device which exposes the photosensitive material, the exposure head comprising:

the light source, formed by a plurality of light emitting elements; and a plurality of lens arrays, which are disposed on an optical axis of said lens, each having lenses of a number corresponding to a number of the plurality of light emitting elements;

wherein the plurality of lens arrays includes a first lens array and a second lens array, and wherein a focal point position, which is located at a light source side, of the second lens array, is set at a position at which a light source image of the light source is focused by the first lens array.

2. An exposure head according to claim 1, wherein a focal point position of each lens on the second lens array, which is located at the light source side, is set at a position at which a light source image of the corresponding light emitting element is focused by the corresponding lens on the first lens array.

3. An exposure head according to claim 1, wherein a focal point position of the first lens array, which is located at a light-exiting side, is set at a position of a field of view plane.

4. An exposure head which projects a light beam from a light source onto a photosensitive material by a lens in an exposure device which exposes the photosensitive material, said exposure head comprising:

the light source formed by a plurality of light emitting elements; and a plurality of lens arrays which are disposed on an optical axis of said lens, each of the plurality of lens arrays having lenses of a number corresponding to a number of the plurality of light emitting elements, wherein the plurality of lens arrays includes a first lens array and a second lens array, the light source and an aperture plane are conjugate with respect to the first lens array, and a field of view plane and an object plane are conjugate with respect to the second lens array.

5. An exposure head according to claim 4, wherein each of the light emitting elements and the aperture plane are conjugate with respect to the respective lenses on the first lens array and the field of view plane and the object plane are conjugate with respect to the respective lenses on the second lens array.

6. An exposure head according to claim 4, wherein a focal point position of the first lens array, which is located at a light-exiting side, is set at a position of the field of view plane.

7. An exposure head which projects a light beam from a light source onto a photosensitive material by a lens in an exposure device which exposes the photosensitive material, the exposure head comprising:

the light source, formed by a plurality of light emitting elements; and a lens array having lenses of a number corresponding to a number of the plurality of light emitting elements;

wherein a focal point position, which is located at a light source side, of a light-exiting surface of the lens array, is set at a position at which a light source image of the light source is focused by a light-incident surface of the lens array.

8. An exposure head according to claim 7, wherein each of the lenses on the lens array includes a light-incident surface portion and a light-exiting surface portion, a focal point position of each light-exiting surface portion of the lenses on the lens array, which is located at the light source side, is set at a position at which a light source image of the corresponding light emitting element is focused by the corresponding light-incident surface portion of the lens on the lens array.

9. An exposure head according to claim 7, wherein a focal point position, which is located at a light-exiting side, of the light-incident surface of the lens array, is set at a position of a field of view plane.

10. An exposure head which projects a light beam from a light source onto a photosensitive material by a lens in an exposure device which exposes the photosensitive material, said exposure head comprising:

the light source formed by a plurality of light emitting elements; and a lens array having lenses of a number corresponding to a number of the plurality of light emitting elements, wherein the light source and an aperture plane are conjugate with respect to the light-incident surface of the lens array, and a filed of view plane and an object plane are conjugate with respect to the light-exiting surface of the lens array.

11. An exposure head according to claim 10, wherein each of the lenses on the lens array includes a light-incident surface portion and a light-exiting surface portion, each of the light emitting elements and the aperture plane are conjugate with respect to the respective light-incident surface portions of the lenses on the lens array and the field of view plane and the object plane are conjugate with respect to the respective light-exiting surface portions of lenses on the lens array.

12. An exposure head according to claim 10, wherein a focal point position, which is located at a light-exiting side, of the light-incident surface of the lens array, is set at a position of the field of view plane.

13. An exposure head which projects a light beam from a light source onto a photosensitive material by a lens in an exposure device which exposes the photosensitive material, the exposure head comprising:

the light source, formed by a plurality of light emitting elements; and a plurality of lens arrays, which are disposed on an optical axis of said lens, each having lenses of a number corresponding to a number of the plurality of light emitting elements;

wherein the plurality of lens arrays includes a first lens array and a second lens array, and wherein a focal point position, which is located at a light source side of the second lens array, is set at a position at which a light source image of the light source is focused by the first lens array, and further wherein the light source and an aperture plane are conjugate with respect to the first lens array, and a field of view plane and an object plane are conjugate with respect to the second lens array.

14. An exposure head which projects a light beam from a light source onto a photosensitive material by a lens in an exposure device which exposes the photosensitive material, the exposure head comprising:

the light source, formed by a plurality of light emitting elements; and a lens array having lenses of a number corresponding to a number of the plurality of light emitting elements;

wherein a focal point position, which is located at a light source side, of a light-exiting surface of the lens array, is set at a position at which a light source image of the light source is focused by a light-incident surface of the lens array, and further wherein the light source and an aperture plane are conjugate with respect to the light-incident surface of said lens array, and a field of view plane and an object plane are conjugate with respect to the light-exiting surface of said lens array.

* * * * *